United States Patent [19]

Bergen

[11] Patent Number: 4,741,309

[45] Date of Patent: May 3, 1988

[54] THROTTLE LOCKING DEVICE FOR A DIESEL ENGINE

[76] Inventor: Corrie Bergen, 139 Whiteside Road, N.E., Calgary, Alberta, Canada, T1Y 1Y6

[21] Appl. No.: 921,429

[22] Filed: Oct. 22, 1986

[51] Int. Cl.[4] ..... F02M 39/00

[52] U.S. Cl. ..... 123/366; 123/179 L; 123/376; 123/368

[58] Field of Search ..... 123/179 L, 366, 368, 123/376, 373

[56] References Cited

U.S. PATENT DOCUMENTS

| | | | |
|---|---|---|---|
| 2,817,323 | 12/1957 | Nallinger | 123/378 |
| 3,270,729 | 9/1966 | Swatek | 123/378 |
| 3,614,946 | 10/1971 | Staudt et al. . | |
| 3,721,309 | 3/1973 | Donaldson | 123/376 |
| 3,795,232 | 3/1974 | Snook | 123/179 L |
| 3,827,419 | 8/1974 | Isomura . | |
| 3,952,714 | 4/1976 | Weyer . | |
| 4,117,821 | 10/1978 | Kawai | 123/179 L |
| 4,147,148 | 4/1979 | Ito | 123/366 |
| 4,176,642 | 12/1979 | Shipinski . | |
| 4,183,342 | 1/1980 | Lohner . | |
| 4,200,079 | 4/1980 | Darlington | 123/179 L |
| 4,458,645 | 7/1984 | Schwartman | 123/378 |
| 4,479,474 | 10/1984 | Djordjevic et al. . | |

FOREIGN PATENT DOCUMENTS

| | | | |
|---|---|---|---|
| 172511 | 3/1952 | Fed. Rep. of Germany | 123/179 L |
| 1002988 | 2/1957 | Fed. Rep. of Germany | 123/368 |
| 54112939 | 4/1981 | Japan | 123/366 |

*Primary Examiner*—Carl Stuart Miller

*Attorney, Agent, or Firm*—Adrian D. Battison; Stanley G. Ade; Murray E. Thrift

[57] ABSTRACT

A device for locking the throttle linkage of a vehicle comprises a bracket having a pair of aligned openings through which a rod of the linkage can pass. A lever pivotally mounted on the bracket has a free end for engaging the rod between the pair of openings so as to clamp the rod at that point and prevent actuation movement. The lever is moved by an air cylinder under control of a valve manually operable within the driver compartment. The driver therefore can adjust the engine rpm to an increased speed using the foot pedal and then lock the linkage at that position to allow the engine to run for a warming up period. The valve is then released to unclamp the linkage and allow normal driving movement of the linkage during operation of the vehicle.

4 Claims, 1 Drawing Sheet

THROTTLE LOCKING DEVICE FOR A DIESEL ENGINE

BACKGROUND OF THE INVENTION

This invention relates to a device for locking the throttle control of a diesel engine so as to maintain that engine at a fixed rpm for a period of time under control of the driver.

Diesel engines can only operate effectively and without damage if they are properly warmed up prior to use of the vehicle within which they are mounted. Contrary to the conventional gasoline engine, diesel engines do not include a choke control, which can be used during the starting process and to increase the idle speed of the engine during the warming-up process.

The normal idle speed of the diesel engine is generally not sufficient to properly warm up the engine and of course drivers are very reluctant to sit holding the conventional foot operated lever at a slightly open position to speed up the engine while it is warming.

Devices have therefore previously been proposed for locking the throttle in a slightly open position so that the engine can run at an increased speed of for example 1,500 rpm for a period of time to achieve proper warmup without the necessity for the driver being present to control the throttle position.

The foot operated lever within the cab or driver compartment communicates through a linkage generally in the form of a rod which moves longitudinally to directly operate upon a lever of the fuel pump. The generally available locking device comprises a cable operable by a pull knob inside the cab or driver compartment which directly pulls upon the lever to the fuel pump. These cable devices have been found to be unsatisfactory in that they are prone to failure and are difficult to adjust to the required rpm. They are therefore unpopular with the operators and are generally not supplied by original equipment manufacturers. Thus, in most cases, they are a subsequent addition to the equipment without proper location for the connection between the cable and the lever thus further reducing the effectiveness of the product.

Various devices have been available in the prior art for use as governors of a diesel engine which operate to vary the fuel pump lever in dependence upon various outside conditions. These are of course expensive and have properties completely unsuitable for the simple requirement with the present invention is concerned, that is, the locking of the fuel pump at or approximately at a required position to run the engine at a slightly increased rate for a period of time until deactuated by the operator.

It is one object of the present invention, therefore, to provide an improved device for controlling the rate of revolution of a diesel engine which is inexpensive to manufacture, efficient in operation and with few wearing parts thus giving long life.

According to the first aspect of the invention therefore is provided a device for controlling the rate of revolution of a diesel engine of a vehicle of the type including an engine compartment within which the diesel engine is mounted, a driver compartment separate from the engine compartment, a fuel flow throttle control device mounted within the engine compartment for varying the amount of fuel fed to the engine so as to vary the rate of revolution thereof, a foot actuable lever mounted within the driver compartment movable to varying positions between a maximum and a minimum position and a linkage communicating movement of the lever to the throttle control device, said device comprising a bracket having a plate member with holes therein for bolting of the plate member to a wall of the engine compartment and a support portion upstanding from the plate member, means defining an opening through the support portion for receiving said rod of said linkage passing therethrough in longitudinal movement thereof, a lever pivotally mounted on said support portion about a transverse axis arranged closer to one end of the lever than to an opposed end thereof, an air actuable cylinder having one end attached to said support portion and an opposed end attached to said opposed end of said lever such that supply of air to said cylinder causes movement of said lever about said pivot axis, said one end of said lever being arranged relative to said opening so as to engage said rod passing therethrough to clamp said rod, and a switch separate from said bracket and having means thereon for mounting of said switch on a wall of said driver compartment, said switch including means for selectively controlling the supply of air to said cylinder.

According to a second aspect of the invention, there is provided a vehicle including a diesel drive engine, an engine compartment within which the engine is mounted, a driver compartment separate from the engine compartment, a fuel flow throttle control device mounted within the engine compartment for varying the amount of fuel fed to the engine so as to vary the rate of revolution thereof, a foot actuable lever mounted within the driver compartment movable to varying positions between a maximum and a minimum position, a linkage communicating movement of the lever to the throttle control device, a clamp member mounted within the engine compartment and arranged to be movable from a first position free from said linkage in which said linkage can freely communicate said movement to a second position in which it clamps against movement said linkage in a position thereof according to the position between the maximum and minimum of the lever, actuating means for moving said clamp member between the first and second positions and a switch mounted within said driver compartment for selectively supplying power to said actuating means.

Contrary to the conventional device which comprises a cable which operates in parallel to the throttle control linkage, the present device operates to clamp the existing throttle control linkage at a position along its length so as to hold the linkage in the required position. The operator therefore instead of trying to control the rate of revolution of the engine by pulling on a cable, simply acts to press the foot throttle lever to the required location to obtain the desired rpm and the operates the switch which immediately clamps the throttle linkage in that location, holding it until the switch is reverted to its first position thus releasing the air from the cylinder.

A specific design provided by the upstanding support brackets as a pair of plate members pivotally mounting the lever and the actuating cylinder therebetween so as to clamp the linkage rod between the lever and the openings through the plate member is a particularly simple and effective technique for providing the clamping mechanism in a device which can be cheaply manufactured and simply mounted within the engine compartment.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the the different figures.

DETAILED DESCRIPTION

Figure 2:
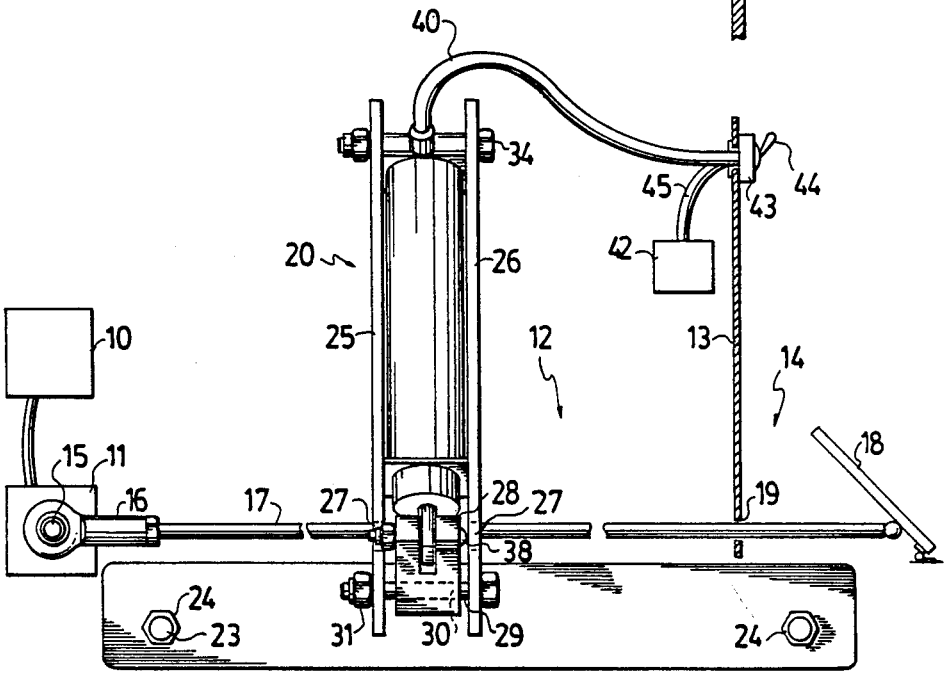
FIG. 2 is a rear elevational view of the device of FIG. 1 showing schematically its mounting within the engine compartment, the foot pedal within the driver compartment and a switch also within the driver compartment.

A conventional vehicle is shown in FIG. 2. For convenience of illustration, the only portions of the vehicle shown are an engien 10 and a fuel pump 11 for that engine both of which are shown schematically. The engine is mounted within a compartment 12 separated by a bulkhead 13 from a driver compartment 14. The fuel pump 11 includes a lever 15 which is operated by an end coupling 16 moved by a rod 17 under control of a conventional foot pedal 18 within the driver's compartment. The rod 17 passes through the bulkhead by means of a schematic opening 19 although of course it will be appreciated that a linkage can of course be more complex depending upon the directions involved.

All of the above features are of course conventional and are therefore shown only schematically. In operation, as is well known, the driver moves the foot pedal 18 to various positions between a maximum and a minimum so as to force the rod 17 along its length to actuate control of the fuel pump thus varying the amount of fuel supplied to the engine to increase or decrease its rate of revolution. The minimum position of the foot pedal 18 is of course arranged at a suitable idle speed of the engine when that engine is properly warmed and the maximum position of the foot pedal represents a fully open position of the control to the fuel pump so as to provide the maximum amount of fuel for which the fuel pump and engine are designed for maximum power output of the engine.

In order to lock the fuel pump in a required position to provide an increased idle speed for warming up purposes, there is provided a locking device generally indicated at 20. The locking device 20 operates on a portion of the rod 17 with the portion of the rod chosen for operation being dependent upon the suitability of that portion determined by its position adjacent a suitable bulkhead or wall defining the compartment of the engine.

Figure 1:
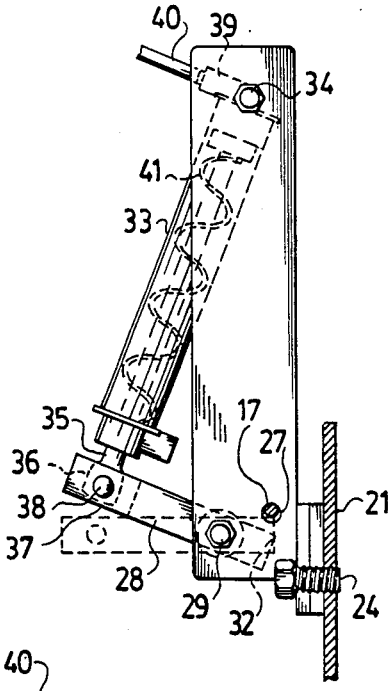
FIG. 1 is a side elevational view of a locking device according to the invention.

In the view shown in FIG. 1, a suitable wall is indicated at 21 which may in some arrangements in fact be bulkhead 13 or it may be constituted by an alternative portion of wall surrounding the engine compartment dependent upon the design of the vehicle.

The device 20 comprises a plate member 22 which has holes 23 by which it can be bolted by bolts 24 to the wall 21. Welded to the plate 22 is a pair of upstanding plates 25 and 26 which are arranged adjacent the centre of the plate 22. The plates 25 and 26 are elongate and extend outwardly to one side of the plate member 22 at right angles thereto so when the plate member 22 is mounted horizontally the plates 25 and 26 extend vertically.

Each of the plates 25 and 26 has an opening 27 therein of a diameter slightly greater than the rod 17 so that the rod 17 can be threaded through the openings and can then move freely transversely to the plates through the openings 27. Thus the openings act as a guide for the rod but normally allow it to slide freely.

A lever 28 is mounted between the plates 25 and 26 on a pivot pin arrangement 29. The pin 29 includes suitable bearings 30 which enable the lever to freely pivot about the axis of the pin. The pin is held in place by a nut 31 so that the lever is securely maintained between the plates 25 and 26 but is free to pivot therebetween about the pin axis which extends generally at right angles to the plates.

At either end of the lever 28 indicated at 32 is arranged beneath the openings 27 so that as the lever moves in an anticlockwise direction as shown in FIG. 1 the end 32 passes across the area of the aligned openings 27 so as to engage the rod 17. Thus the end 32 acts as one side of a clamp pressing the rod against an opposed face of the openings 27 to hold the rod 17 against longitudinal movement.

Actuation of the lever 28 to obtain the clamping movement is provided by an air cylinder 33. The fixed end of the cylinder is mounted on a pivot pin 34 similar to the pin 29 so that the fixed end is free to pivot about an axis at right angles to the plates but is held laterally fixed relative to the plates. A piston rod 35 of the cylinder extends from the other end of the cylinder and has a clevis 36 pivotally attached to an end 37 of the lever remote from the clamping end 32. The pivotal attachment between the clevis 36 and the end 37 of the lever is provided by a further pin 38. For this purpose the lever 28 is bifercated so that the clevis extends into a recess centrally thereof.

The spacing between the end 32 and the pin 29 is less than the spacing between the pin 29 and the pin 38 so as to provide a mechanical advantage to the operation of the cylinder 33.

The fixed end of the cylinder 33 carries an air supply nipple 39 connected to an air line 40. The nipple 39 provides a single acting expansion stroke of the piston 35 within the cylinder 33 with a return stroke of the piston being generated by a compression spring 41 within the cylinder. Thus the supply of air at the nipple 39 causes the piston to move outwardly from the cylinder to provide a clamping movement of the lever 28. Release of the air pressure of the nipple 39 causes the spring 41 to retract the lever 28 to an unclamped position.

Supply of air at the line 40 from the compressed air supply of the vehicle schematically indicated at 42 is controlled by a valve 43 mounted on the bulk head 13 and including a manually operable lever 44. Thus the valve 43 is of the type including a body which can pass through an opening in the bulkhead to clamp the valve to the bulkhead exposing on the driver side of the bulkhead merely the manually operable lever 44 which selectively controls the supply of compressed air from the compressor to the line 40 and thus to the nipple 39 in dependence upon the requirement of the driver.

The device can therefore be simply mounted as a retrofit attachment to an existing motor vehicle by attachment of the mounting plate 22 to a suitable bulkhead, threading of the rod 17 through the openings 27 and attachment of the valve 43 and lines 40 and 45 to the requisite locations. As an alternative, the device can of course be supplied as original equipment.

In operation the driver after starting the engine 10 depresses the foot pedal 18 to a position which increases the velocity of the engine to a required rpm in accordance with the judgment of the driver. At that point the manually operable switch 44 is simply actuated to lock the rod 17 in the selected position in dependence upon the position of the foot pedal 18. The foot pedal 18 can than be released and driver leave the cab if required or if wishing to do so leaving the engine running at a rate greater than idle speed.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A vehicle including a diesel drive engine, an engine compartment within which the engine is mounted, a driver compartment separate from the engine compartment, a fuel flow throttle control device mounted within the engine compartment for varying the amount of fuel fed to the engine so as to vary the rate of revolution thereof, a foot actuable lever mounted within the driver compartment movable to varying positions between a maximum and minimum position of said throttle control device, a linkage system connected to the throttle control device and movable in response to actuation of said lever, said linkage system including an elongate rod, a clamp member mounted within the engine compartment said clamp member including a support member having an opening therethrough through which the rod passes and which constrains the rod to move in a direction longitudinal of the rod and a clamp body mounted on said suport member and movable relative to said support member from a first position free from said rod in which said rod can freely move in said opening in response to actuation of said lever to a second position in which the clamp body engages said rod and presses said rod against a side of said opening so as to clamp said rod between said clamp body and said side to hold the throttle control device at a position between the maximum and minimum positions of the throttle control device, and an air operated cylinder mounted on said support member for moving said clamp body between the first and second positions thereof and a switch mounted within said driver compartment for selectively supplying operating air to said air operated cylinder.

2. A device for controlling the rate of revolution of diesel engine of a vehicle of the type including an engine compartment within which the diesel engine is mounted, a driver compartment separate from the engine compartment, a fuel flow throttle control device mounted within the engine compartment for varying the amount of fuel fed to the engine so as to vary the rate of revolution thereof, a foot actuable lever mounted within the driver compartment movable to varying positions between a maximum and a minimum position and a linkage communicating movement of the lever to the throttle control device, said device comprising a bracket having a plate member with holes therein for bolting of the plate member to a wall of the engine compartment and a support portion upstanding from the plate member, means defining an opening through the support portion for receiving said rod of said linkage passing therethrough in longitudinal movement thereof, a lever pivotally mounted on said support portion about a transverse axis arranged closer to one end of the lever than to an opposed end thereof, an air actuable cylinder having one end attached to said support portion and an opposed end attached to said opposed end of said lever such that supply of air to said cylinder causes movement of said lever about said pivot axis, said one end of said lever being arranged relative to said opening so as to engage said rod passing therethrough to clamp said rod, and a switch separate from said bracket and having means thereof for mounting of said switch on a wall of said driver compartment, said switch including means for selectively controlling the supply of air of said cylinder.

3. The invention according to claim 2 wherein said support bracket comprises a pair of spaced parallel plates and wherein said lever and said actuating means are mounted between said plates on respective pivot pins coupled therebetween and wherein said opening means is defined by two aligned openings each in a respective one of the plates such that said lever operates on a portion of the rod passing between said plates.

4. The invention according to claim 3 including a plate member arranged at right angles to said spaced parallel plates and having a plurality of openings therein for mounting of said plate member on a wall of the engine compartment.

* * * * *